US011604010B2

(12) United States Patent
Lei et al.

(10) Patent No.: US 11,604,010 B2
(45) Date of Patent: Mar. 14, 2023

(54) CO-AXTAL, DOUBLE-INLET VALVE FOR PULSE TUBE CRYOCOOLER

(71) Applicant: Sumitomo (SHI) Cryogenics of America, Inc., Allentown, PA (US)

(72) Inventors: Tian Lei, Allentown, PA (US); Mingyao Xu, Allentown, PA (US); Ralph C. Longsworth, Mount Desert, ME (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 57 days.

(21) Appl. No.: 17/411,725

(22) Filed: Aug. 25, 2021

(65) Prior Publication Data

US 2022/0065500 A1 Mar. 3, 2022

Related U.S. Application Data

(60) Provisional application No. 63/071,240, filed on Aug. 27, 2020.

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1411* (2013.01); *F25B 2309/14181* (2013.01)

(58) Field of Classification Search
CPC .... F25B 9/145; F25B 9/10; F25B 2309/1411; F25B 2309/1413; F25B 2309/1418; F25B 2309/1426
See application file for complete search history.

(56) References Cited

U.S. PATENT DOCUMENTS 3,205,668 A 9/1965 Gifford
3,237,421 A 3/1966 Gifford
(Continued)

FOREIGN PATENT DOCUMENTS

CN 210772908 U 6/2020
JP 09-004936 A 1/1997
JP 3917123 B2 5/2007

OTHER PUBLICATIONS

International Search Report and Written Opinion of the International Searching Authority dated Dec. 24, 2021, from the corresponding International Application No. PCT/US2021/047575.

*Primary Examiner* — Lionel Nouketcha
(74) *Attorney, Agent, or Firm* — Katten Muchin Rosenman LLP

(57) ABSTRACT

A Gifford-McMahon (GM) type double-inlet pulse tube system providing cooling at cryogenic temperatures is provided. The system has a co-axial double-inlet valve that includes a base having an adjustable port, a fixed needle partially engaged in one end of the adjustable port, an adjustable needle partially engaged in another end of said adjustable port, and a body for housing the base, the fixed needle and the adjustable needle. The base is configured to be adjustable along an axial direction. The adjustable needle is arranged co-axially with the fixed needle. The adjustable port and the adjustable needle are configured to control an alternating current (AC) flow and a direct current (DC) flow between the stem port and the end port and to produce the DC flow in either direction between the stem port and the end port.

17 Claims, 3 Drawing Sheets

(56) References Cited

U.S. PATENT DOCUMENTS

| | | | | |
|---|---|---|---|---|
| 5,595,065 | A | 1/1997 | Boiarski et al. | |
| 9,157,668 | B2 | 10/2015 | Xu | |
| 10,066,855 | B2 | 9/2018 | Xu et al. | |
| 2008/0092588 | A1 | 4/2008 | Xu et al. | |
| 2011/0000225 | A1* | 1/2011 | Xu | F25B 9/145 62/6 |
| 2011/0100022 | A1 | 5/2011 | Yuan et al. | |
| 2016/0069593 | A1 | 3/2016 | Tsuchiya et al. | |

* cited by examiner

CO-AXTAL, DOUBLE-INLET VALVE FOR PULSE TUBE CRYOCOOLER

CROSS REFERENCE TO RELATED APPLICATIONS

This application claims the priority of U.S. Provisional Application Ser. No. 63/071,240, filed on Aug. 27, 2020, which is hereby incorporated herein by reference in its entirety.

FIELD OF THE INVENTION

This invention relates to an improved double-inlet valve for a Gifford-McMahon (GM) type pulse tube cryocooler that simplifies adjustment to get good cooling capacity.

BACKGROUND

The Gifford-McMahon (GM) type pulse tube refrigerator is a cryocooler, similar to GM refrigerators, that derives cooling from the compression of gas in a compressor connected to an expander by supply and return hoses, the expander cycling gas through inlet and outlet valves to a cold expansion space through a regenerator. A GM expander creates the cold expansion space by the reciprocation of a solid piston (a piston is often referred to as a displacer when the displaced volume above and below the piston are connected by a regenerator) in a cylinder while a pulse tube expander creates the cold expansion space by the reciprocation of a "gas piston". Pulse tube refrigerators have no moving parts in their cold head, but rather an oscillating gas column within the pulse tube that functions as a compressible piston. The piston comprises the gas that stays in the pulse tube as it is pressurized and depressurized. The elimination of moving parts in the cold end of pulse tube refrigerators allows a significant reduction of vibration, as well as greater reliability and lifetime. Two stage GM type pulse tube refrigerators typically use oil lubricated compressors to compress helium and draw 5 to 15 kW, or more, of input power. Major applications today are cooling MM (magnetic resonance imaging) and NMR (nuclear magnetic resonance imaging) magnets, where they cool heat shields at about 40 K and recondense helium at around 4 K. They are also being used in the early development of quantum computers. These applications require low levels of vibration and low levels of EMI, electromagnetic interference.

GM type pulse tube coolers have been developed in parallel with Stirling type pulse tube coolers which provide the pressure cycle to the regenerator and pulse tube directly from a reciprocating compressor piston. These are widely used in cooling infrared detectors near 70 K in ground and space based systems. They are typically much smaller, and run at much higher speeds e.g. 60 Hz versus 1 to 2 Hz for GM type pulse tubes. Stirling type pulse tubes are more efficient than GM type pulse tubes because they recover much of the work of expansion but the means of controlling the flow between the warm end of the pulse tube and a buffer volume is different, and they are not as efficient at low temperatures.

W. E. Gifford who was a co-inventor of the GM cycle refrigerator also conceived of an expander that replaced the solid piston with a gas piston and called it a "pulse tube" refrigerator. This was first described in his U.S. Pat. No. 3,237,421 ("the '421 patent") which shows a pulse tube connected to valves like the earlier GM refrigerators. Early development of the pulse tube expander demonstrated that gas entering a vertically oriented tube at the bottom and flowing through a flow smoothing mesh created a stratified column of gas that got hot as it was compressed and pushed towards the top. The top of the tube had a copper cap that absorbed some of the heat so that when the gas flowed out of the tube and cooled as it expanded it cooled the flow smoother and adjacent copper in what is called the cold end. A significant improvement was made to the basic GM type pulse tube by Mikulin et al., as reported in 1984, by adding a buffer volume at the warm end of the pulse tube and flowing gas in and out through a throttle valve. This is now called a basic orifice type pulse tube or a single-inlet valve pulse tube. Subsequent development work has led to the design of several different means of throttling the flow that improve the performance of the pulse tube expander. Most Stirling type pulse tubes are of the single-inlet design.

For GM type pulse tubes it was found that the addition of a second orifice between the warm end of the pulse tube and the inlet to the regenerator improved the performance and made it possible to get below 4 K in a two stage pulse tube. This is now called a double-inlet pulse tube and the second throttling device is called a double-inlet valve. As was the case with the single-inlet valve taking on different forms, the double-inlet valve has taken on different forms. The present invention is a new double-inlet valve that has made it possible to get good performance by easily fine tune the setting of the valve.

U.S. Pat. No. 3,205,668 ("the '668 patent") by Gifford describes a GM expander that has a solid piston having a stem attached to the warm end which drives the displacer up and down by cycling the pressure above the drive stem out of phase with the pressure cycle to the expansion space. Rotary valves are the most common means of cycling the pressures between high, Ph, and low, Pl. One can think of the flow control at the warm end of a pulse tube as being optimized if the cold boundary of the gas piston follows essentially the same pattern as the cold end of the solid piston. A cycle with the expander described in the '668 patent starts with the displacer held down while the inlet valve opens and increases the pressure to Ph. The piston then moves up and at about ¾ of the way the inlet valve closes and the pressure drops as the piston moves to the top. The outlet valve then opens and the pressure drops to Pl. The piston then moves down and at about ¾ of the way the outlet valve closes and the pressure increases as the piston moves to the bottom. The area of the P-V (pressure-volume) is a measure of the refrigeration produced per cycle. The differences between a solid piston and a gas piston are numerous. They include 1) the length and stroke depend on the pressure ratio and how much gas is allowed to flow in and out of the cold end of the pulse tube, 2) an asymmetry in the valve timing and flow resistances can cause more gas to flow in or out of one end of the pulse tube each cycle than to flow out or in, referred to as direct current (DC) flow, and 3) it is very difficult to balance the flow in and out of the cold and warm ends simultaneously to establish a cold boundary, referred to as alternating current (AC) flow, that simulates the movement and the P-V relation of a solid piston. The Stirling cycle pulse tubes with a single-inlet valve avoid the first problem because the compressor piston has a fixed displacement, and it avoids the second problem because the same amount of gas flows out of the buffer volume as flows into it.

While this analogy of a gas piston with a solid piston provides a physical description of the process, it is more common to find the flow patterns described in terms of the phase relationship between the pressure cycle and the mass flow cycle. Patent Application No. US2011/0100022 ("the '022 application") by Yuan et al. has a good description of phase control devices for Stirling type single-inlet pulse tube cryocoolers. FIG. 2 of the '022 application shows resistive devices which are described as including an orifice, a short tube, and closely spaced plates. FIG. 2 shows an inertance tube which is a long small diameter tube that acts as an inductance in an electrical analogy. FIG. 8 of the '022 application shows how these devices can be combined using an electrical circuit analogy to optimize the phase relationship between the pressure cycle and the mass flow cycle that provides the most cooling. FIG. 7 of the '022 application is a schematic of a single-inlet valve that is comprised of a resistive device in parallel with an inertance device. It is important to note that an inertance device is practical in a Stirling type pulse tube because it is operating at a high frequency. At the low frequencies of GM type pulse tubes, only resistive devices are practical. It is also important to note that all of the devices described in the '022 application have the same flow characteristics with flow in either direction.

Efforts to increase the cooling capacity of two-stage GM type coolers at 4K have included the development of the four-valve design. U.S. Pat. No. 10,066,855 ("the '855 patent") by Xu describes a four-valve pulse tube. This name derives from the phase shifting mechanism comprising a pair of inlet and outlet valves that connect to the warm end of the regenerator and a second pair of inlet and outlet valves that connect to the warm end of the pulse tube. The '855 patent describes flow control mechanisms to balance the flow of gas to second and third stage pulse tubes, each of which requires an additional pair of valves. The four-valve pulse tube does not use a buffer volume and present designs perform slightly better than present designs of double-inlet pulse tubes. They are at a disadvantage however when the valve motor and rotary valve have to be separated from the regenerator. A double-inlet pulse tube only requires one hose between the valve assembly and the pulse tube/regenerator assembly, referred to as the cold end, while the four-valve pulse tube needs one hose to connect to the regenerator and smaller diameter hoses connected to the warm ends of each pulse tube in a multi-stage pulse tube. The improved performance of a double-inlet pulse tube with the present invention makes it possible to get performance that is as good as a four-valve pulse tube in a unit with a remote valve assembly and a single connecting hose. A patent application for an improved connecting hose has recently been filed.

Japanese (JP) Patent No. 3917123 by Ogura describes the use of a needle valve for the double-inlet valve and a replaceable bushing with a short hole through it for the first inlet valve. The short hole through the bushing has the same flow restriction in either direction for the same flow conditions. It is a symmetric flow restrictor. The needle valve on the other hand, as it is depicted, has a port at the end that looks at the point of the needle and a port on the side that looks at the stem, the flow restriction being different for flow at the same conditions in different directions. The flow restriction is asymmetric. The degree of asymmetry depends on a number of factors such as beveling the inlets to the ports, the length of the holes in the ports, etc. Improvements in phase shifting were made possible by simplifying the means of making adjustments.

In addition to optimizing the phase shifting mechanism that controls the P-V relationship in GM type pulse tubes operating near 4 K it was also found to be important to control the DC flow. U.S. Pat. No. 9,157,668 ("the '668 patent") by Xu describes a double-inlet pulse tube to which a bleed line between a buffer volume and the compressor return line has been added. FIG. 1 of the '668 patent shows the prior art basic double-inlet pulse tube and describes the flow pattern through the double-inlet valves as generating too much DC flow from the warm end to the cold end of the pulse tube. The bleed line from the buffer volume back to the return side of the compressor reduces the DC flow to a rate that optimizes the cooling. This has the disadvantage when the valve assembly is remote from the cold end of requiring an additional connecting line. A two stage double-inlet pulse tube has two pulse tubes in parallel that extend from room temperature to first and second stage temperatures. The warm end of each connects to its own buffer volume and has its own double-inlet valves. The second stage regenerator is an extension of the first stage regenerator so the pressure drop through the first stage regenerator to the cold end of the first stage pulse tube is less than the pressure drop to the cold end of the second stage pulse tube. Optimizing the DC flow in a two stage pulse tube might require having an upward DC flow in the second stage and a downward DC flow in the first stage.

The present invention is a double-inlet valve that simplifies the setting of the AC flow and the DC flow to optimize the available cooling. It also only requires a single connecting hose between a remote valve assembly and the cold head.

SUMMARY

A co-axial double-inlet valve for a double-inlet GM type pulse tube cryocooler includes a fixed needle in series with an axially adjustable port and an opposing axially adjustable needle. The overall flow resistance can be adjusted and the asymmetry of the flow can be adjusted in either direction. The valve is typically located in the warm flange of the cold head and is accessible for adjustment from one end. A standard size valve can be used for the first and second stages of a two-stage pulse tube or different size pulse tubes. This valve simplifies the setting of the AC flow and the DC flow to optimize the available cooling. A double-inlet valve pulse tube requires only a single connecting hose to a remote valve assembly in applications where isolation of vibration and EMI from the cold head is important.

These advantages and others are achieved by a GM type double-inlet pulse tube system providing cooling at cryogenic temperatures. The GM type double-inlet pulse tube system includes a co-axial double-inlet valve that includes a base having an adjustable port, a fixed needle partially engaged in one end of the adjustable port, an adjustable needle partially engaged in another end of said adjustable port, and a body for housing the base, the fixed needle and the adjustable needle. The base is configured to be adjustable along an axial direction. The adjustable needle is arranged co-axially with the fixed needle. The base defines a cavity connected to a stem port formed on the body, the body defines a cavity connected to an end port formed on the body, and the adjustable port is located between the cavity of the base and the cavity of the body. The adjustable port and the adjustable needle are configured to control an AC flow and a DC flow between the stem port and the end port and to produce the DC flow in either direction between the stem port and the end port.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTIONS

Figure 1:
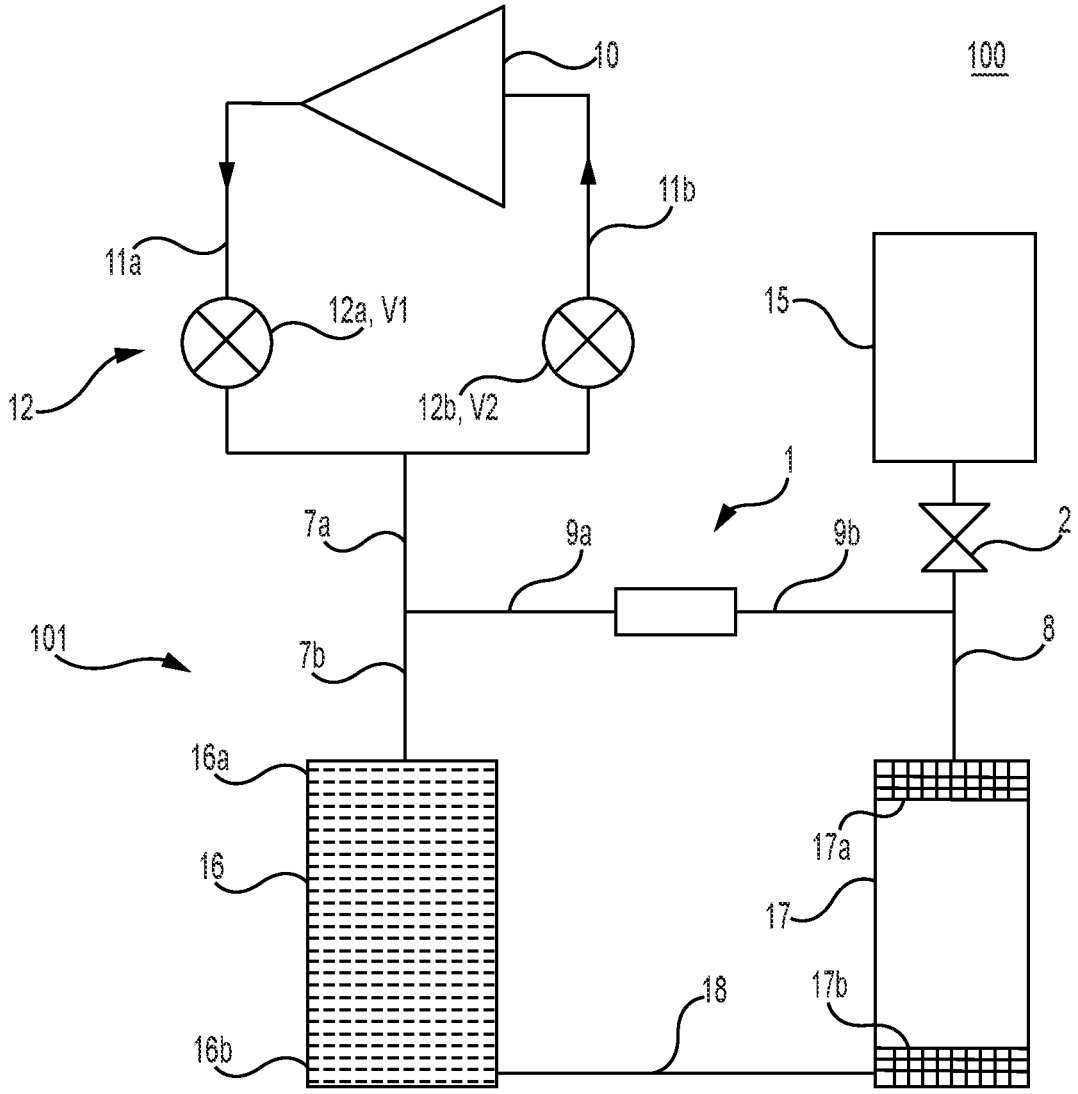
FIG. 1 shows a schematic of a single stage GM type double-inlet pulse tube system having a co-axial double-inlet valve of this invention.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments. Parts that are the same or similar in the drawings have the same numbers and descriptions are usually not repeated.

With reference to FIG. 1, shown is a schematic of a single stage GM type double-inlet pulse tube system 100 having a co-axial double-inlet valve 1 of the disclosed invention. The co-axial double-inlet valve 1 is shown in context of the entire system. The single stage GM type double-inlet pulse tube system 100 includes a compressor 10, a valve assembly 12 including valves 12*a* and 12*b*, and a pulse tube cold head 101 that is connected to the valve assembly 12 through connecting line 7*a*. Compressor 10 is connected to supply valve 12*a*, V1, through supply line 11*a*, and return valve 12*b*, V2, through return line 11*b*. Lines 11*a* and 11*b* are typically flexible metal hoses 5 to 20 meter long, and valves 12*a* and 12*b* are typically slots in a motor driven rotary valve rotating over ports in a stationary seat. Gas, usually helium, cycles in pressure between the supply and return pressures, typically 2.2 MPa and 0.6 MPa, as it flows through connecting line 7*a* to the warm end of the double-inlet pulse tube 17. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 7*a*, to a pulse tube cold head 101. Connecting line 7*a* can be a few millimeters long if valves 12*a* and 12*b* are integral to the cold head 101 or it can be a single flexible hose up to 0.5 meter long or more if the valves are remote.

The pulse tube cold head 101 includes regenerator 16 having a warm end 16*a* and a cold end 16*b*, pulse tube 17 having a warm flow smoother 17*a* at a warm end and a cold flow smoother 17*b* at a cold end, line 18 connecting the regenerator cold end 16*b* of the regenerator 16 to the cold flow smoother 17*b* of the pulse tube 17, line 7*b* extending from the connecting line 7*a* to the warm end 16*a* of the regenerator 16, line 9*a* extending from the line 7*b* to a co-axial double-inlet valve 1, line 8 extending from the warm flow smoother 17*a* of the pulse tube 17 to a buffer volume 15 through a single-inlet valve 2, and line 9*b* extending from the co-axial double-inlet valve 1 to the line 8 and to the warm flow smoother 17*a* of the pulse tube 17. Cycling flow continues to the warm end 16*a* of regenerator 16 through line 7*b*, and to the co-axial double-inlet valve 1, line 9*b* and line 8 through line 9*a*. Line 8 connects at one end to the warm end of pulse tube 17, which contains warm flow smoother 17*a*, and at the other end to single-inlet valve 2, which in turn connects to buffer volume 15. The cold end 16*b* of regenerator 16 connects through line 18 to the cold end of pulse tube 17 which contains cold flow smoother 17*b*.

Figure 2:
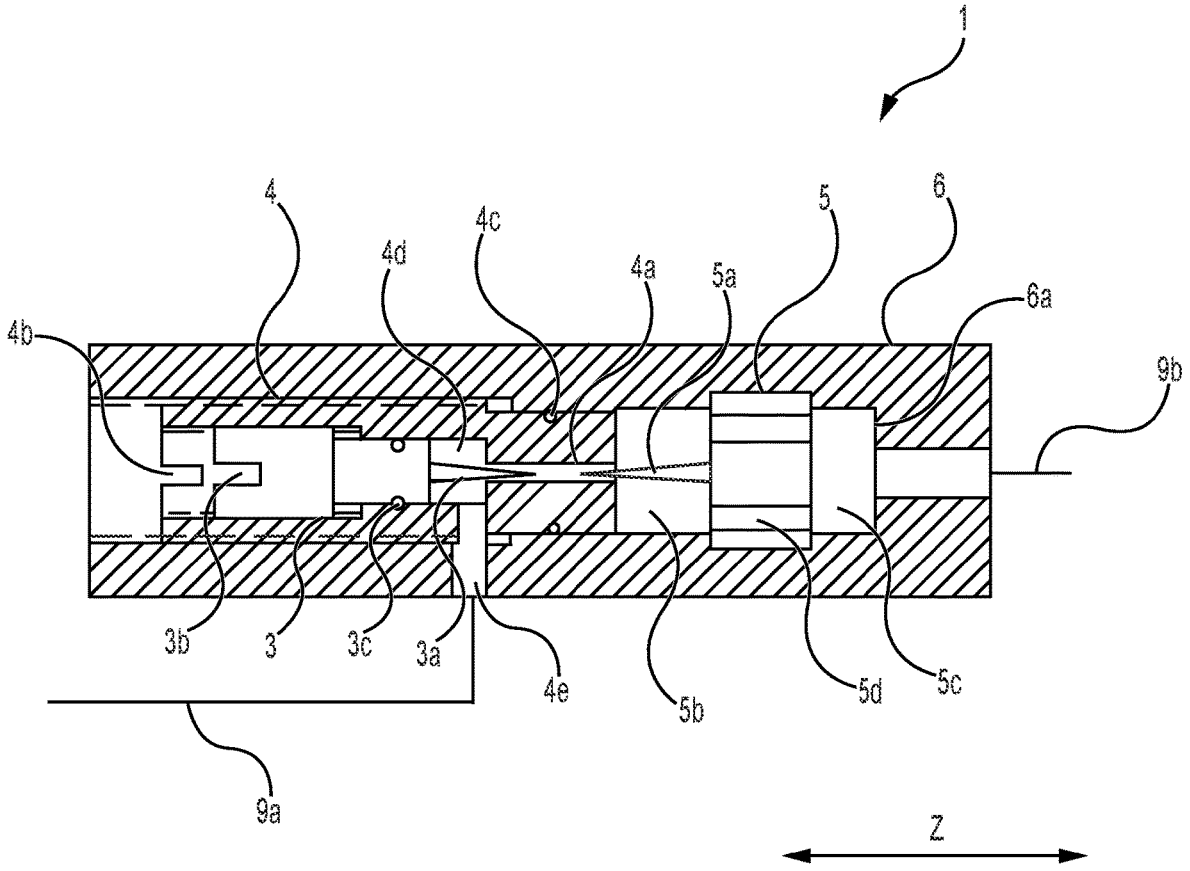
FIG. 2 shows a schematic of a co-axial double-inlet valve of this invention.

With reference to FIG. 2, shown is a schematic of co-axial double-inlet valve 1. Valve body 6 of the co-axial double-inlet valve 1 is typically the warm flange of the pulse tube cold end 101 but may be part of an external piping assembly. Needle 5*a* is integral to needle base 5 which is fixed in valve body 6. Valve port base 4, which has holes for gas to flow through, is co-axially aligned with needles 3*a* and 5*a*, and the valve port base 4 is axially adjustable by a threaded engagement in valve body 6. Needle 3*a* is integral to adjustable needle base 3 which is axially adjustable by a threaded engagement in port base 4. The port base 4 has an adjustable port 4*a* in which the needles 3*a* and 5*a* may be partially inserted. Slots 3*b* and 4*b* allow engagement of a tool to rotate needle base 3 and port base 4 independently from the same end of valve body 6 to adjust the needle base 3 and port base 4. Seals 3*c* and 4*c* are used to make the co-axial double-inlet valve 1 airtight.

Referring to FIG. 2, the body 6 has a hole 6*a* inside the body 6, and the fixed needle base 5 and the valve port base 4 are disposed in the hole 6*a*. The valve port base 4 has the adjustable port 4*a* and a hole (or cavity) 4*d* inside the valve port base 4, and the adjustable needle base 3 is disposed in the hole 4*d*. The hole 4*d* is connected to a stem port 4*e* which is connected to the line 9*a* which is connected to the line 7*b* as shown in FIG. 1. The adjustable needle 3*a* extending from the adjustable needle base 3 is disposed in the hole 4*d* and is partially disposed inside the adjustable port 4*a*. The fixed needle 5*a* extending from the fixed needle base 5 is disposed in the hole 5*b* and is partially disposed inside the adjustable port 4*a*. When the valve port base 4 and/or the adjustable needle base 3 are adjusted along the axial direction Z, the size of the hole 4*d* and the length of a portion of the needle 3*a* that is disposed inside the adjustable port 4*a* may be adjusted. When the valve port base 4 is adjusted along the axial direction Z, the adjustable port 4*a* moves along the axial direction Z and the length of a portion of the needle 5*a* which is disposed inside the adjustable port 4*a* may be adjusted.

The hole (or cavity) 5*b* may be formed between the valve port base 4 and the fixed needle base 5, and is connected to the hole 4*d* through the adjustable port 4*a*. The fixed needle body 5 is disposed between the hole 5*b* and the end port 5*c*, and has at least one connection port 5*d*. The end port 5*c* is connected to the port 5*b* through the connection port 5*d*. The end port 5*c* is connected to the line 9*b* which is connected to the line 8 as shown in FIG. 1. While the drawing shows a specific shape, but not the sizes, of needles 3*a* and 5*a*, and port 4*a*, other configurations are within the scope of this invention. If needles 3*a* and 5*a* are withdrawn from port 4*a* symmetrically, then the AC flow rate increases symmetrically, and if one is open more than the other, then the flow is asymmetric, the resistance for flow from the needle to the base that is more engaged being greater than that for flow from the needle that is less engaged. This asymmetry introduces DC flow, which can be set in either direction by which of the two needles is more engaged.

Figure 3:
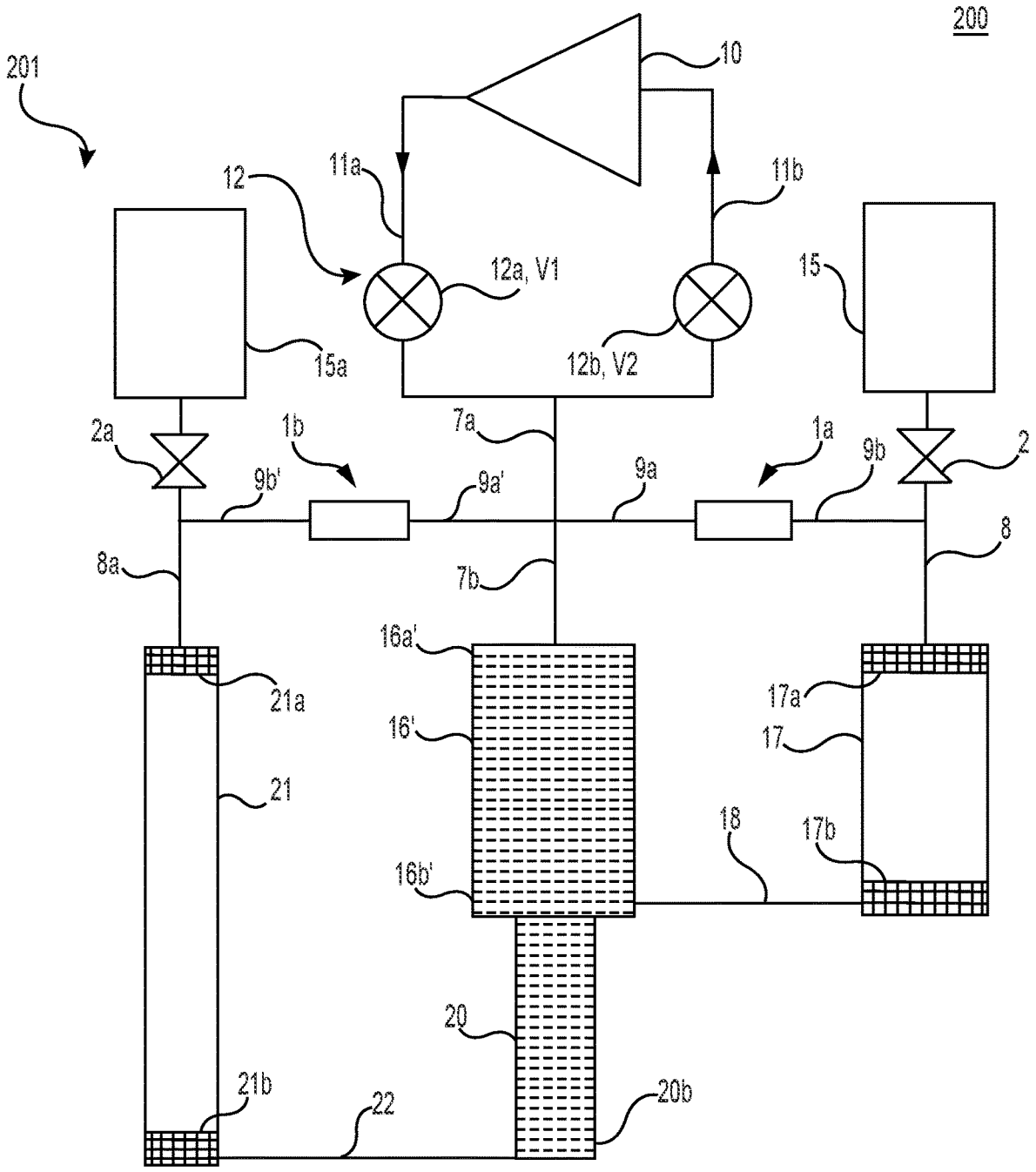
FIG. 3 shows a schematic of a two stage GM type double-inlet pulse tube system having two co-axial double-inlet valves of this invention.

With reference to FIG. 3, shown is a schematic of a two stage GM type double-inlet pulse tube system 200 having multiple co-axial double-inlet valves 1*a* and 1*b* of the disclosed invention. The two stage GM type double-inlet pulse tube system 200 includes a compressor 10, a valve assembly 12 including valves 12*a* and 12*b*, and a pulse tube cold head 201 that is connected to the valve assembly 12 through connecting line 7*a*. Compressor 10 is connected to supply valve 12*a*, V1, through supply line 11*a*, and return valve 12*b*, V2, through return line 11*b*. Lines 11*a* and 11*b* are typically flexible metal hoses 5 to 20 meter long, and valves 12*a* and 12*b* are typically slots in a motor driven rotary valve rotating over ports in a stationary seat. Gas, usually helium, cycles in pressure between the supply and return pressures, typically 2.2 MPa and 0.6 MPa, as it flows through connecting line 7*a* to the warm end of the double-inlet pulse tubes 17 and 21. The compressor 10 supplies gas at a supply pressure through a supply line 11*a* and receives gas at a return pressure through a return line 11*b*. The valves 12*a* and 12*b* are respectively connected to the supply line 11*a* and return line 11*b* that cycles gas between the supply pressure and the return pressure, through a connecting line 7*a*, to a pulse tube cold head 201. Connecting line 7*a* can be a few millimeters long if valves 12*a* and 12*b* are integral to the cold head 201 or it can be a single flexible hose up to 0.5 meter long or more if the valves are remote.

Referring to FIG. 3, the pulse tube cold head 201 includes first stage regenerator 16' having a warm end 16*a*' and a cold end 16*b*', second stage regenerator 20 attached to the cold end 16*b*' of the first stage regenerator 16' and having a cold end 20*b*, first stage pulse tube 17 having a warm flow smoother 17*a* at a warm end and a cold flow smoother 17*b* at a cold end, second stage pulse tube 21 having a warm flow smoother 21*a* at a warm end and a cold flow smoother 21*b* at a cold end, line 18 connecting the regenerator cold end 16*b*' to the cold flow smoother 17*b* of the pulse tube 17, line 22 connecting the cold end 20*b* of the second stage regenerator 20 to the cold flow smoother 21*b* of the pulse tube 21, line 7*b* extending from the connecting line 7*a* to the warm end 16*a*' of the regenerator 16', line 9*a* extending from the line 7*b* to co-axial double-inlet valves 1*a*, line 9*a*' extending from the line 7*b* to co-axial double-inlet valves 1*b*, line 8 extending from the warm flow smoother 17*a* of the pulse tube 17 to a buffer volume 15 through a single-inlet valve 2, line 8*a* extending from the warm flow smoother 21*a* of the pulse tube 21 to a buffer volume 15*a* through a single-inlet valve 2*a*, line 9*b* extending from the co-axial double-inlet valve 1*a* to the line 8 and to the warm flow smoother 17*a* of the pulse tube 17, and line 9*b*' extending from the co-axial double-inlet valve 1*b* to the line 8*a* and to the warm flow smoother 21*a* of the pulse tube 21.

A first co-axial double-inlet valve 1*a* is connected to first stage pulse tube 17, and a second co-axial double-inlet valve 1*b* is connected to second stage pulse tube 21. The second co-axial double-inlet valve 1*b* includes the same elements as the first co-axial double-inlet valve 1*a*. The end port 5*c* of the second co-axial double-inlet valve 1*b* may be connected to the line 9*b*' and the stem port 4*e* of the second co-axial double-inlet valve 1*b* may be connected to the line 9*a*'. The second co-axial double-inlet valve 1*b* is equivalent to the first co-axial double-inlet valve 1*a* but may have different sizes of the adjustable port 4*a*, needle 3*a* and needle 5*a*. As shown in FIG. 3 the second stage regenerator 20 is an extension of first stage regenerator 16', and second stage pulse tube 21 is separate from first stage pulse tube 17, with the warm end at room temperature. The cold end 20*b* of regenerator 20 connects through line 22 to the cold end of pulse tube 21, which has flow smoother 21*b*. The warm end of second stage pulse tube 21 has flow smoother 21*a* and connects to line 8*a*, which connects to co-axial double-inlet valve 1*b* and buffer volume 15*a* through single-inlet valve 2*a*.

The terms and descriptions used herein are set forth by way of illustration only and are not meant as limitations. Those skilled in the art will recognize that many variations are possible within the spirit and scope of the invention and the embodiments described herein.

What is claimed is:

1. A Gifford-McMahon (GM) type double-inlet pulse tube system providing cooling at cryogenic temperatures, comprising:

a co-axial double-inlet valve comprising:

a base having an adjustable port, wherein the base is configured to be adjustable along an axial direction;

a fixed needle partially engaged in one end of the adjustable port;

an adjustable needle partially engaged in another end of said adjustable port, wherein the adjustable needle is arranged co-axially with the fixed needle; and a body for housing the base, the fixed needle and the adjustable needle.

2. The GM type double-inlet pulse tube system of claim 1 wherein the base and the adjustable needle are adjustable from the same side of the body.

3. The GM type double-inlet pulse tube system of claim 1 wherein the base defines a cavity connected to a stem port formed on the body, the body defines a cavity connected to an end port formed on the body, and the adjustable port is located between the cavity of the base and the cavity of the body.

4. The GM type double-inlet pulse tube system of claim 3 wherein the adjustable port and the adjustable needle are configured to control an alternating current (AC) flow and a direct current (DC) flow between the stem port and the end port.

5. The GM type double-inlet pulse tube system of claim 3 wherein the adjustable port and the adjustable needle are configured to produce a DC flow in either direction between the stem port and the end port.

6. The GM type double-inlet pulse tube system of claim 3 wherein the co-axial double-inlet valve further comprises an adjustable needle base located in the cavity of the base, and the adjustable needle is integral to the adjustable needle base.

7. A Gifford-McMahon (GM) type double-inlet pulse tube system providing cooling at cryogenic temperatures, comprising;

a compressor supplying gas at a supply pressure through a supply line and receiving gas at a return pressure through a return line;

a valve assembly connected to the supply and return lines;

a pulse tube cold head connected to the valve assembly, wherein the valve assembly cycles gas between the supply pressure and the return pressure to the pulse tube cold head through a connecting line, the pulse tube cold head comprising:

a regenerator having a warm end and a cold end;

a pulse tube having a warm end and a cold end;

a co-axial double-inlet valve comprising:

a base having an adjustable port, wherein the base is configured to be adjustable along an axial direction;

a fixed needle partially engaged in one end of the adjustable port;

an adjustable needle partially engaged in another end of said adjustable port, wherein the adjustable needle is arranged co-axially with the fixed needle; and a body for housing the base, the fixed needle and the adjustable needle;

a first line extending from the connecting line to the warm end of the regenerator, wherein the co-axial double-inlet valve is connected to the first line;

a second line connecting the cold end of the regenerator to the cold end of the pulse tube;

a third line extending from the warm end of the pulse tube to a buffer volume through a single-inlet valve; and a fourth line extending from the co-axial double-inlet valve to the warm end of the pulse tube.

8. The GM type double-inlet pulse tube system of claim 7 wherein the base and the adjustable needle are adjustable from the same side of the body.

9. The GM type double-inlet pulse tube system of claim 7 wherein the base defines a cavity connected to a stem port formed on the body, the body defines a cavity connected to an end port formed on the body, and the adjustable port is located between the cavity of the base and the cavity of the body.

10. The GM type double-inlet pulse tube system of claim 9 wherein the stem port is connected to the first line and the end port is connected to the fourth line.

11. The GM type double-inlet pulse tube system of claim 9 wherein the adjustable port and the adjustable needle are configured to control an alternating current (AC) flow and a direct current (DC) flow between the stem port and the end port.

12. The GM type double-inlet pulse tube system of claim 9 wherein the adjustable port and the adjustable needle are configured to produce a DC flow in either direction between the stem port and the end port.

13. The GM type double-inlet pulse tube system of claim 9 wherein the co-axial double-inlet valve further comprises an adjustable needle base located in the cavity of the base, and the adjustable needle is integral to the adjustable needle base.

14. The GM type double-inlet pulse tube system of claim 7 wherein the connecting line between the valve assembly and the pulse tube cold head is a single flexible hose.

15. The GM type double-inlet pulse tube system of claim 7 wherein the connecting line between the valve assembly and the pulse tube cold head is at least 0.5 meter long.

16. The GM type double-inlet pulse tube system of claim 7 wherein the pulse tube cold head further comprises:

a second stage regenerator connected to the cold end of the regenerator;

a second stage pulse tube having a warm end and a cold end;

a second stage co-axial double-inlet valve connected to the first line, comprising;

a base having an adjustable port, wherein the base is configured to be adjustable along an axial direction;

a fixed needle partially engaged in one end of the adjustable port;

an adjustable needle partially engaged in another end of said adjustable port, wherein the adjustable needle is arranged co-axially with the fixed needle; and a body for housing the base, the fixed needle and the adjustable needle;

a fifth line connecting an cold end of the second stage regenerator to the cold end of the second stage pulse tube;

a sixth line extending from the warm end of the second stage pulse tube to a second stage buffer volume through a second stage single-inlet valve; and a seventh line extending from the second stage co-axial double-inlet valve to the warm end of the second stage pulse tube.

17. The GM type double-inlet pulse tube system of claim 16 wherein at least one of the adjustable port, fixed needle and adjustable needle of the second stage co-axial double-inlet valve has a different size from corresponding one of the adjustable port, fixed needle and adjustable needle of the co-axial double-inlet valve.

* * * * *